US008152008B2

(12) United States Patent
Cho

(10) Patent No.: US 8,152,008 B2
(45) Date of Patent: Apr. 10, 2012

(54) BOTTLE CAP WITH ADDITIVE SUPPLYING STRUCTURE

(76) Inventor: Young Kook Cho, Marietta, GA (US)

( * ) Notice: Subject to any disclaimer, the term of this patent is extended or adjusted under 35 U.S.C. 154(b) by 907 days.

(21) Appl. No.: 12/221,861

(22) Filed: Aug. 7, 2008

(65) Prior Publication Data

US 2009/0057262 A1 Mar. 5, 2009

(51) Int. Cl.

| | |
|---|---|
| ***B65D 50/08*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 41/04*** | (2006.01) |
| ***B65D 41/34*** | (2006.01) |
| ***B65D 1/04*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |
| ***B65D 51/18*** | (2006.01) |

(52) U.S. Cl. ..... 215/227; 215/6; 215/252; 215/329; 220/253; 220/521; 220/522

(58) Field of Classification Search ..... 215/6, 252, 215/227, 231, 329; 220/521, 522, 253
See application file for complete search history.

(56) References Cited

U.S. PATENT DOCUMENTS

| | | | |
|---|---|---|---|
| 2,807,384 | A | 9/1956 | Lipari |
| 2,813,649 | A | 11/1957 | Lipari |
| 3,220,588 | A | 11/1965 | Lipari |
| 5,088,627 | A | 2/1992 | Musel |
| 5,419,445 | A | 5/1995 | Kaesemeyer |
| 6,045,254 | A | 4/2000 | Inbar et al. |

OTHER PUBLICATIONS

U.S. Appl. No. 10/588,362, filed Aug. 3, 2006, Cho.
U.S. Appl. No. 11/818,705, filed Jun. 15, 2007, Cho.
U.S. Appl. No. 11/975,634, filed Oct. 18, 2007, Cho.
U.S. Appl. No. 12/001,849, filed Dec. 13, 2007, Cho.
U.S. Appl. No. 12/221,861, unpublished, Cho.

*Primary Examiner* — Anthony Stashick
*Assistant Examiner* — Andrew T Kirsch

(57) ABSTRACT

A bottle cap including an additive holding unit which is supported in a mouth of a bottle has in a lower portion thereof an opening for discharging the additive, and is open at the top. An open-and-shut unit is seated to be coaxial with the additive holding unit and moves up and down to open or shut the opening. An outer cap unit includes a sealing tube which is placed between the open-and-shut unit and the additive holding unit and performs a sealing function. A skirt having a forgery preventing function is integrally provided on a lower end of the outer cap body. A delay hook retains the skirt for a period when the opening is opened, thus delaying separation of the skirt.

14 Claims, 8 Drawing Sheets

BOTTLE CAP WITH ADDITIVE SUPPLYING STRUCTURE

BACKGROUND OF THE INVENTION

1. Field of the Invention

The present invention relates generally to a bottle cap with an additive supplying structure and, more particularly, to a bottle cap with an additive supplying structure, in which a delay hook is provided on a skirt of an outer cap unit, the skirt being used for forgery prevention, so that the delay hook delays the separation of the skirt, and an open-and-shut unit allows the additive of an additive holding unit to be added to the contents of a bottle during the time while the separation of the skirt is delayed, and the additive holding unit is secured to the mouth of the bottle, thus preventing a user's clothes or other articles from being soiled with the additive.

2. Description of the Related Art

Generally, a bottle cap functions to prevent contents from escaping from a bottle.

Recently, a bottle cap which allows the addition of an additive has been developed. However, the bottle cap with the additive supplying structure is larger in size than an existing bottle cap, and has a complex appearance, so that prior instruction is required by users. Since it is required to inform consumers how to use the cap, additional expenses are incurred, and furthermore a manufacturer has difficulty in manufacturing and distributing the bottle cap.

SUMMARY OF THE INVENTION

Accordingly, the present invention has been made keeping in mind the above problems occurring in the prior at, and an object of the present invention is to provide a bottle cap with an additive supplying structure, which has an appearance similar to that of a general bottle cap, and allows a user to open the bottle cap in the same manner as one opens the general cap, and has a simple manufacturing process.

Another object of the present invention is to provide a bottle cap with an additive supplying structure, in which the separation of a skirt is delayed when the bottle cap is opened in the same manner as a conventional bottle cap, and the additive is discharged and added to contents in a bottle while the separation of the skirt is delayed, thus allowing the additive to be naturally added to the contents of the bottle without additional manipulation for the addition of the additive.

A further object of the present invention is to provide a bottle cap with an additive supplying structure, which has an appearance very similar to that of a conventional bottle cap, so that it is convenient to distribute and stock the bottle cap, and furthermore an economical manufacturing process is possible, and a user can use the bottle cap without undue reluctance.

In order to accomplish the above objects, the present invention provides a bottle cap with an additive supplying structure, in which a skirt having a delay function is provided on an outer cap unit, a wing-type contact part seals the lower end of an additive holding unit, which holds an additive and has an opening in a lower portion thereof, and the lower end of an open-and-shut unit which opens or shuts the opening, and a sealing tube is provided on an outer cap body to surround and seal the open-and-shut unit.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, the embodiments of the present invention will be described in detail with reference to the accompanying drawings.

Figure 1:
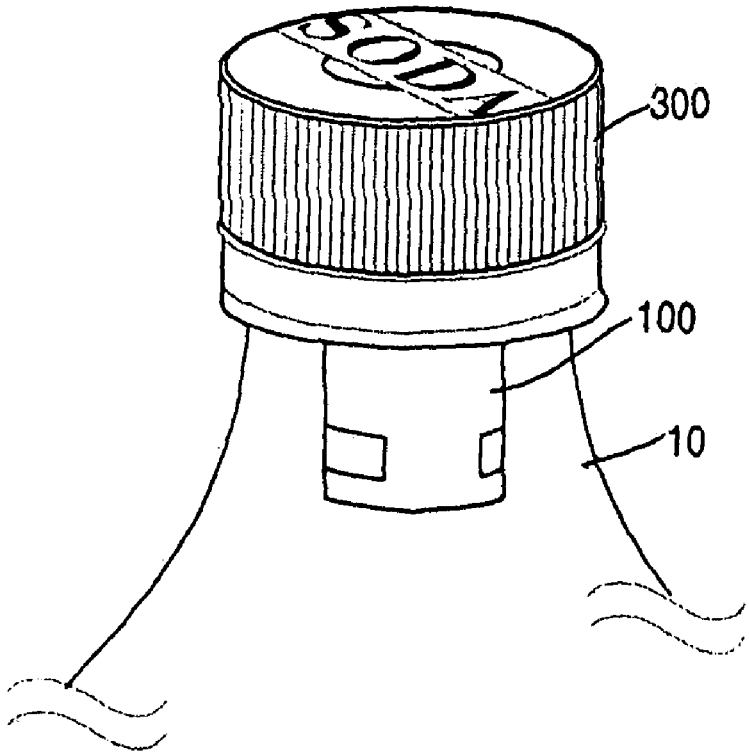
FIG. 1 is a perspective view illustrating a bottle cap with an additive supplying structure according to the present invention.
Figure 2:
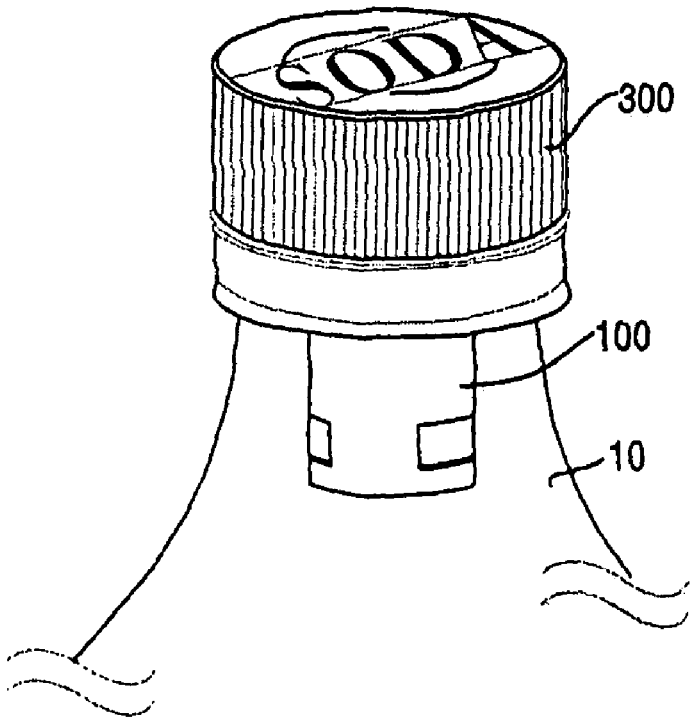
FIG. 2 is a perspective view illustrating the state in which it is ready to add the additive of the bottle cap according to the present invention.
Figure 3:
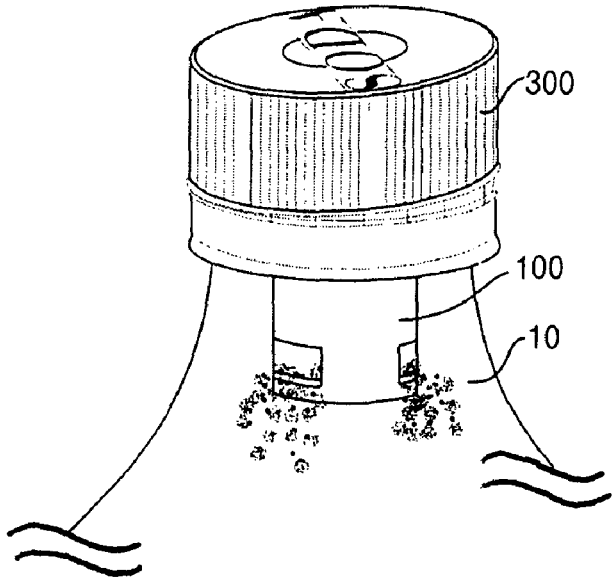
FIG. 3 is a perspective view illustrating the process of adding the additive of the bottle cap according to the first embodiment of the present invention.
Figure 4:
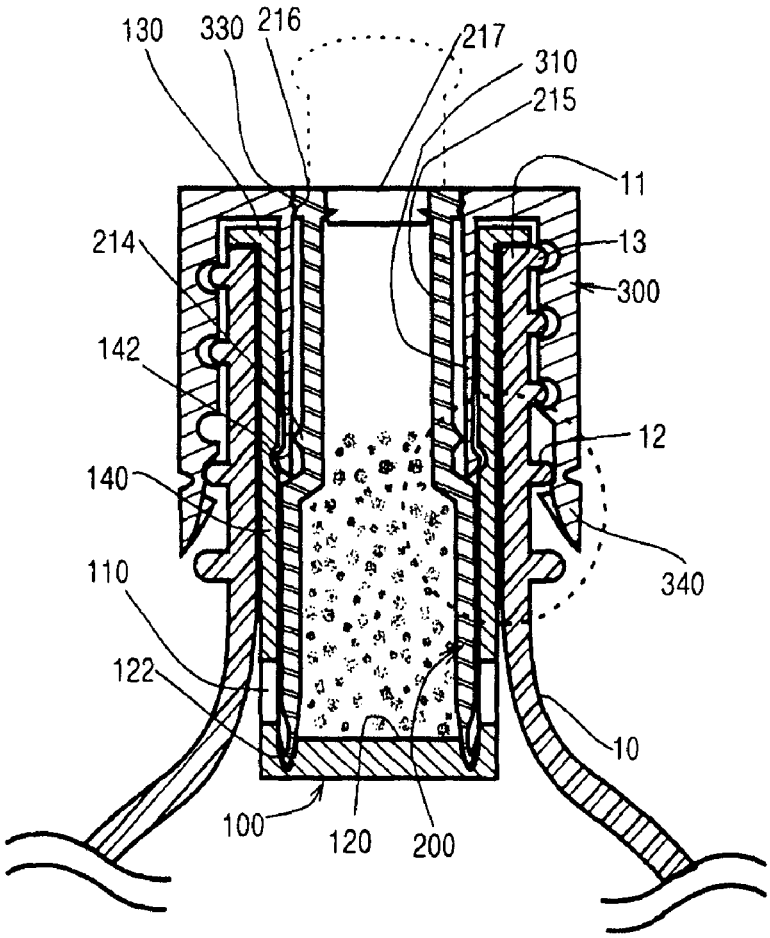
FIG. 4 is a sectional view illustrating a bottle cap with an additive supplying structure according to the first embodiment of the present invention.
Figure 5:
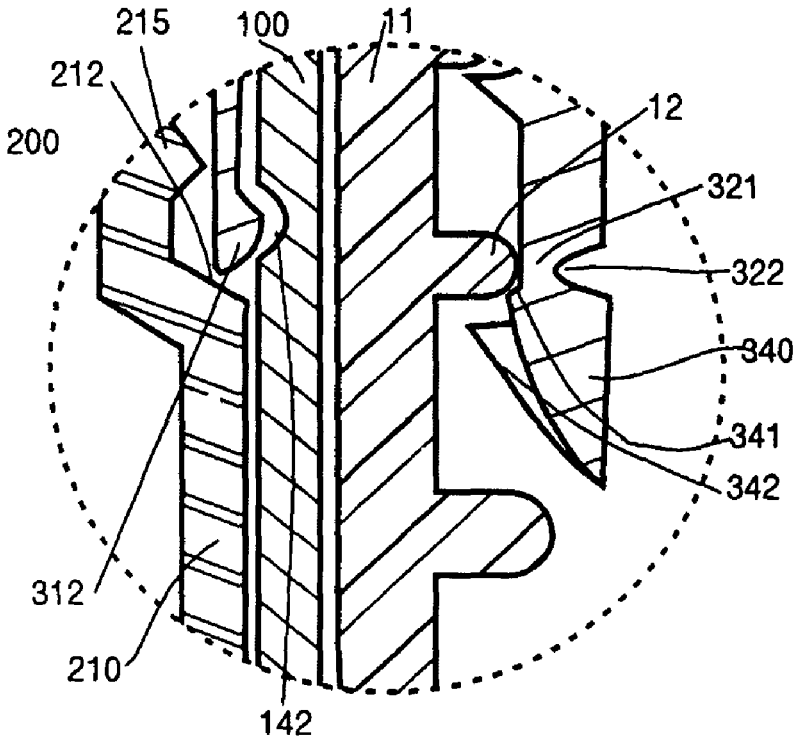
FIG. 5 is an enlarged sectional view illustrating the circled portion of FIG. 4.
Figure 6:
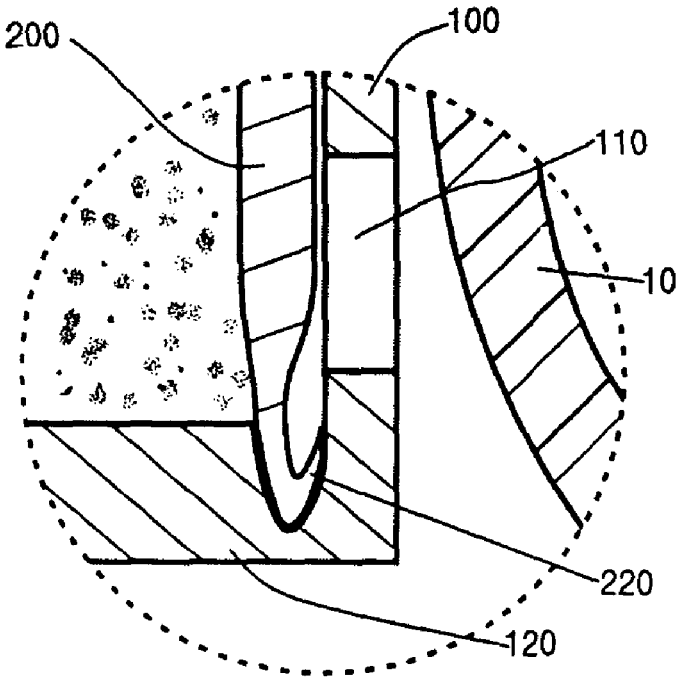
FIG. 6 is an enlarged sectional view illustrating important parts when an additive holding unit and an open-and-shut unit of the bottle cap according to the first embodiment of the present invention are coupled to each other.
Figure 7:
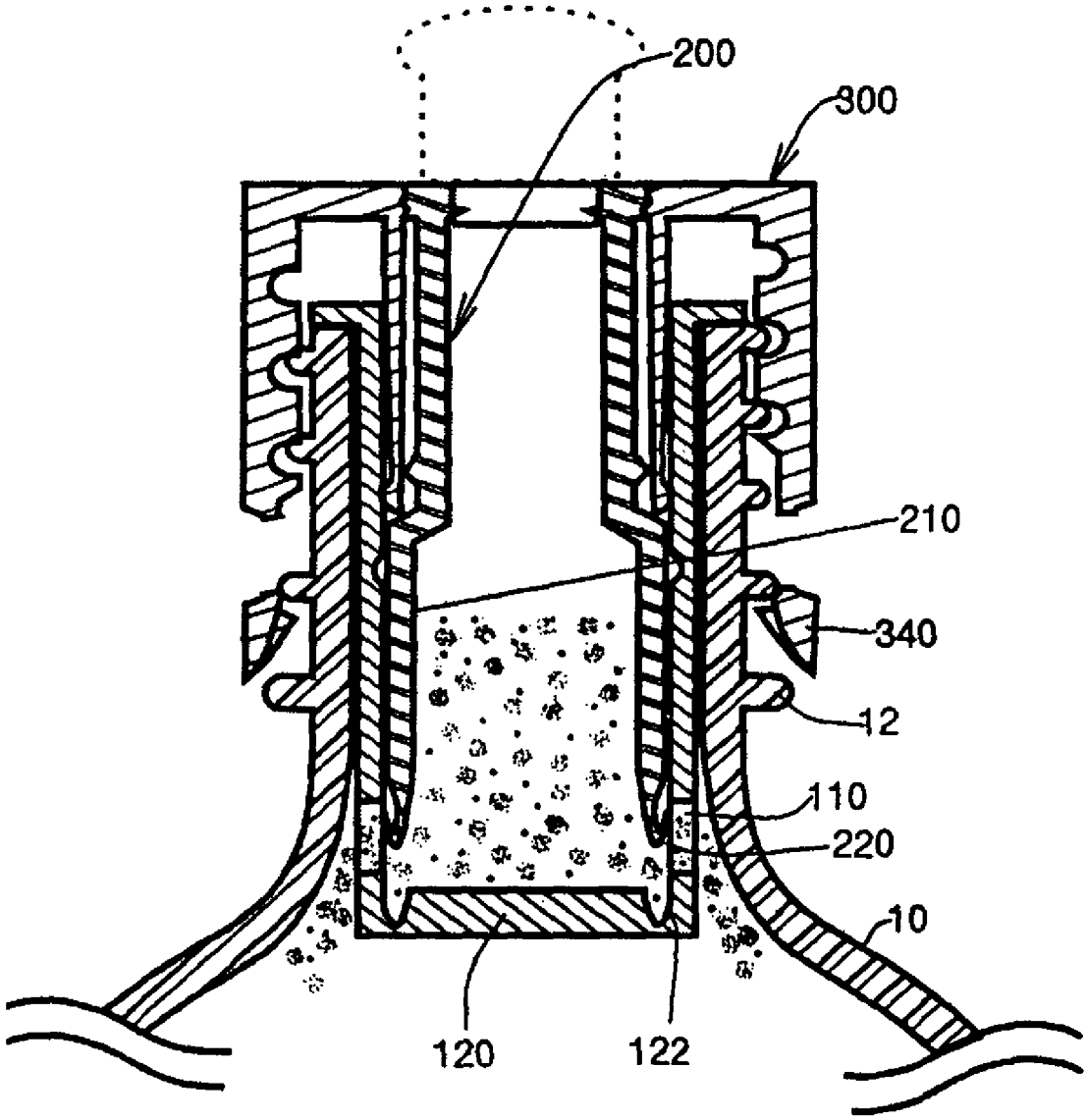
FIG. 7 is a sectional view illustrating the use of the bottle cap according to the first embodiment of the present invention.
Figure 8:
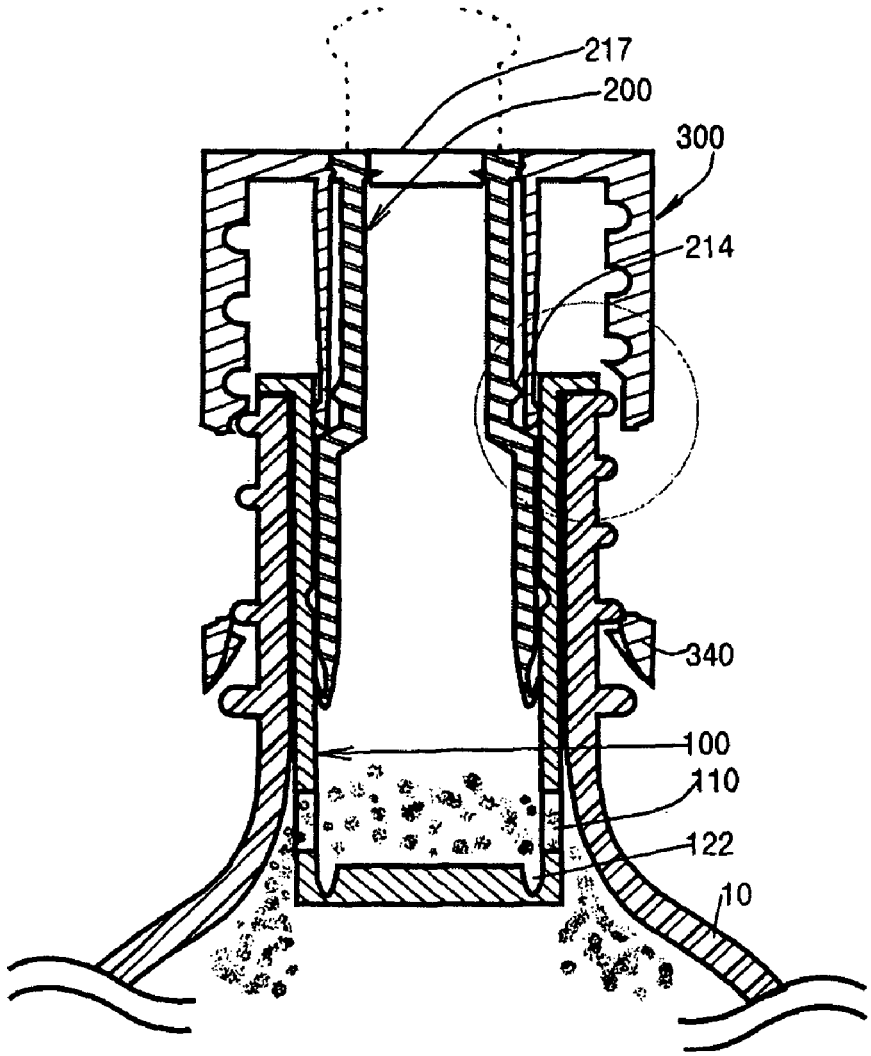
FIG. 8 is a sectional view illustrating the state just before an outer cap unit of the bottle cap is separated according to the first embodiment of the present invention.
Figure 9:
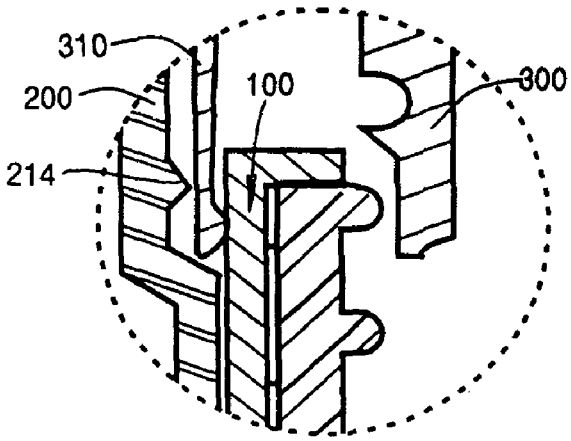
FIG. 9 is an enlarged sectional view illustrating the circled portion of FIG. 8.

FIG. 4 is a sectional view illustrating a bottle cap with an additive supplying structure according to the first embodiment of the present invention, FIG. 5 is an enlarged sectional view illustrating the circled portion in FIG. 4, FIG. 6 is an enlarged sectional view illustrating important parts when an additive holding unit and an open-and-shut unit of the bottle cap according to the first embodiment of the present invention are coupled to each other, FIG. 7 is a sectional view illustrating the use of the bottle cap according to the first embodiment of the present invention, FIG. 8 is a sectional view illustrating a state just before an outer cap unit of the bottle cap is separated according to the first embodiment of the present invention, and FIG. 9 is an enlarged sectional view illustrating the circled portion of FIG. 8. The bottle cap with the additive supplying structure includes an additive holding unit 100, an open-and-shut unit 200, and an outer cap unit 300. The additive holding unit 100 is opened at the top, and is supported by an upper flange 130 placed in a mouth 11 of a bottle 10, which is formed through injection molding using synthetic resin, such as polyethylene or polypropylene. An opening 110 is provided in the side surface of the lower portion of the additive holding unit 100 to discharge the additive.

The open-and-shut unit 200 is seated to be coaxial with the additive holding unit 100, and moves up and down to open or shut the opening 110.

The outer cap unit 300 includes a sealing tube 310, an outer cap body 320, and a coupling part 330. The sealing tube 310 is placed between the open-and-shut unit 200 and the additive holding unit 100, and performs a sealing function. The outer cap body 320 supports at the center thereof the sealing tube 310, and is fastened to the outer portion of the mouth 11 of the bottle 10 through a screw-type fastening method. The coupling part 330 is provided on the inner wall of the upper end of the sealing tube 310 to be coupled to the open-and-shut unit 200.

Here, a skirt 340 having a forgery preventing function is integrally provided on the lower end of the outer cap body 320, and is secured to a skirt locking ring 12 of the bottle 10. Further, a delay hook 342 is provided on the inner wall of the skirt 340, and retains the partially separated skirt 340 for a period when the opening 10 is opened by turning the outer cap unit 300, thus delaying the separation of the skirt 340.

An initial coupling hook 341 is provided on the upper end of the inner wall of the skirt 340. The delay hook 342 is provided under the coupling hook 341 in such a way that there is a predetermined height difference between the delay hook 342 and the coupling hook 341 provided on the upper end of the inner wall of the skirt 340.

A wing-type contact part 220 is provided on the lower end of the open-and-shut unit 200, and an annular wing seating groove 122 is provided in the edge of a floor member 120 of the additive holding unit 100 in such a way as to be tapered in a direction from an upper end of the groove 122 to a lower end thereof, so that the wing-type contact part 220 is hermetically sealed by the annular wing seating groove 122.

A sealing protrusion 312 is provided on the lower end of the sealing tube 310, and is hermetically sealed by a sealing groove 142 which is provided in the inner wall of a body 140 which forms the sidewall of the additive holding unit 100.

A cylindrical body 210, forming the sidewall of the open-and-shut unit 200, reduces at a middle inclined step 212 thereof a diameter, thus providing a small-diameter part 215. A fastening thread 216 is provided on the outer portion of the upper end of the small-diameter part 215 to be fastened to the coupling part 330, and a sealing stopper 217 seals the inner portion of the upper end of the small-diameter part 215.

Compression locking ribs 150 are provided on the outer wall of the body 140 to be secured to the inner wall of the mouth 11 of the bottle 10 through press fitting.

Figure 13:
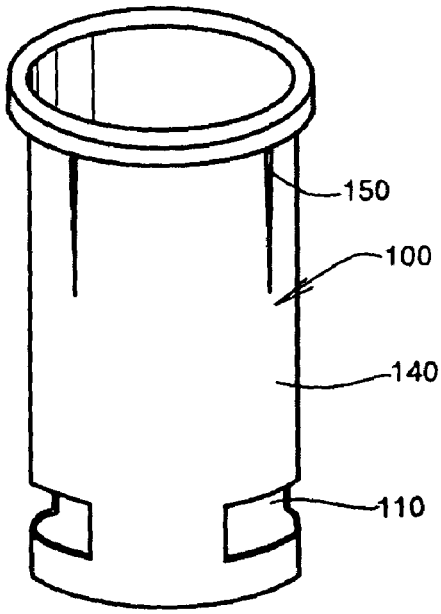
FIG. 13 is a perspective view illustrating an additive holding unit of the bottle cap according to the second embodiment of the present invention.

When the bottle cap constructed as described above is first assembled, the additive holding unit 100 having the appearance of FIG. 13 is press-fitted into the mouth 11 of the bottle 10, as shown in FIGS. 4 and 5. Next, the fastening thread 216 of the open-and-shut unit 200 is fastened to the coupling part 330 of the outer cap unit 300 through a screw-type fastening method. The bottle 10 is next capped as shown in FIG. 4. Subsequently, the additive is put through the open top of the open-and-shut unit 200, and the open-and-shut unit 200 is sealed by the sealing stopper 217.

When a user intends to use the bottle 10 in such a state, at the initial stage of opening, the initial coupling hook 341 is hooked to the skirt locking ring 12 of the mouth 11. Afterwards, as the outer cap unit 300 moves upwards, the coupling hook 341 is removed from the skirt locking ring 12. However, the movement of the outer cap unit 300 is restricted by the delay hook 342, and a tearing wall 321 having a tearing notch 322 is torn later by the elastic pulling operation of synthetic resin. Thereby, the skirt 340 is also torn later by this operation. Such a delaying operation allows the opening 110 to be opened from the state of FIG. 6 to that of FIG. 7. The wing-type contact part 220 is folded and inserted into the wing seating groove 122, and maintains a sealing state during the delay period when the wing-type contact part 220 moves upwards in the wing seating groove 122 as a result of the upward movement of the outer cap unit 300. However, when the outer cap unit 300 is moved further upwards, the sealing protrusion 312 is released from the sealing groove 142. As the sealing protrusion 312 moves further upwards, the sealing protrusion 312 is in close contact with the inner wall of the additive holding unit 100 due to the outward pushing operation of a pushing protrusion 214 of the small diameter part 215 whose diameter is reduced at the inclined step 212, so that the sealing operation is maintained. Thus, until the outer cap unit 300 is changed from the state of FIG. 7 to that of FIGS. 8 and 9 so as to be removed from the bottle 10, sealing is ensured.

Therefore, although a user opens the bottle cap in the conventional manner, the separation of the skirt 340 is delayed, and the opening 110 is opened for the delay period, so that during the delay period the additive is added to the contents of the bottle 10. Thus, while the user opens the bottle cap in the conventional manner unreluctantly, the additive can be naturally discharged.

Figure 10:
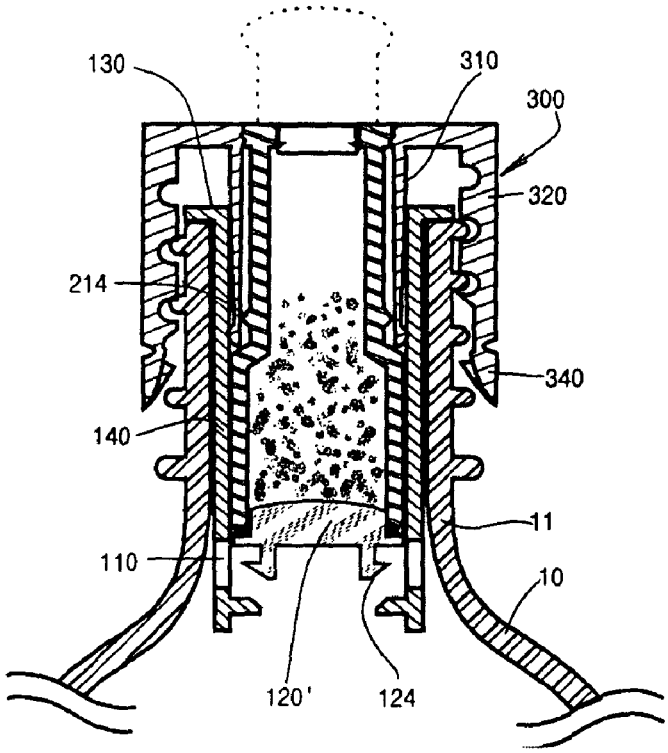
FIG. 10 is a sectional view illustrating the assembled state of a bottle cap with an additive supplying structure according to the second embodiment of the present invention.
Figure 11:
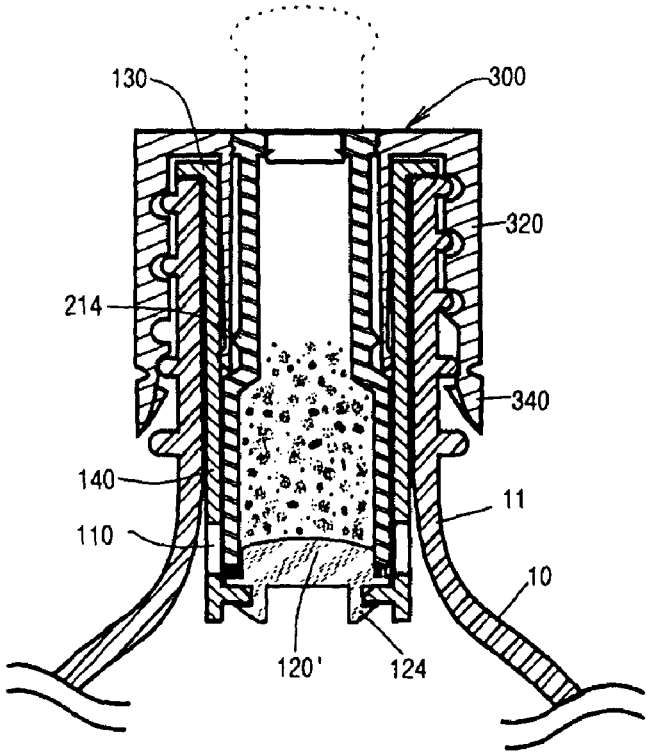
FIG. 11 is a sectional view illustrating the assembled state of FIG. 10.
Figure 12:
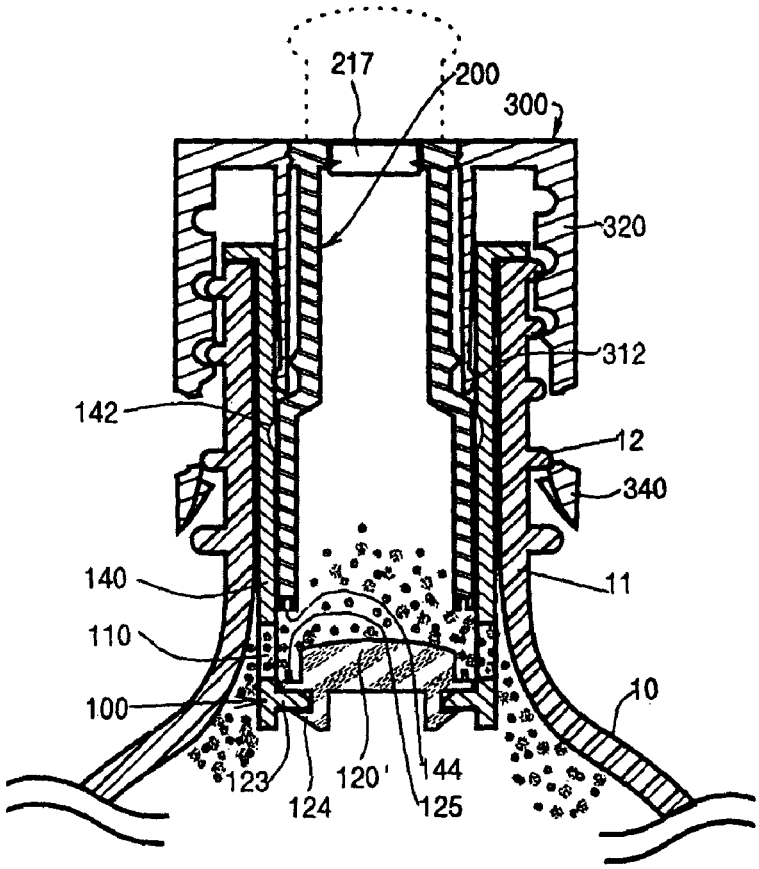
FIG. 12 is a sectional view illustrating the use of the bottle cap according to the second embodiment of the present invention.

FIG. 10 is a sectional view illustrating the assembled state of a bottle cap with an additive supplying structure according to the second embodiment of the present invention. FIG. 11 is a sectional view illustrating the assembled state of FIG. 10. FIG. 12 is a sectional view illustrating the use of the bottle cap according to the second embodiment of the present invention, and FIG. 13 is a perspective view illustrating an additive holding unit of the bottle cap according to the second embodiment of the present invention. The bottle cap with the additive supplying structure includes an additive holding unit 100, an open-and-shut unit 200, and an outer cap unit 300. The additive holding unit 100 is open at the top, and is supported by an upper flange 130 in a mouth 11 of a bottle 10. An opening 110 is provided in the side surface of the lower portion of the additive holding unit 100 to discharge the additive into the bottle.

The open-and-shut unit 200 is seated to be coaxial with the additive holding unit 100, and moves up and down to open or shut the additive opening 110.

The outer cap unit 300 includes a sealing tube 310, an outer cap body 320, and a coupling part 330. The sealing tube 310 is placed between the open-and-shut unit 200 and the additive holding unit 100, and performs a sealing function. The outer cap body 320 supports at the center thereof the sealing tube 310, and is fastened to the outer portion of the mouth 11 of the bottle 10 through a screw-type fastening method. The coupling part 330 is provided on the inner wall of the upper end of the sealing tube 310 to be coupled to the open-and-shut unit 200.

Here, a skirt 340 having a forgery preventing function is integrally provided on the lower end of the outer cap body 320, and is secured to a skirt locking ring 12 of the bottle 10. Further, a delay hook 342 is provided on the inner wall of the skirt 340, and retains the skirt 340 for a period when the opening 10 is opened by turning the outer cap unit 300, thus delaying the separation of the skirt 340.

An initial coupling hook 341 is provided on the upper end of the inner wall of the skirt 340. The delay hook 342 is provided under the coupling hook 341 in such a way that there is a predetermined height difference between the delay hook 342 and the coupling hook 341 which is provided on the upper end of the inner wall of the skirt 340.

The bottom of the additive holding unit 100 comprises a doughnut-shaped support 123, and a floor member 120' is secured to the inner wall of the support 123 using a locking hook 124. The floor member 120' of the additive holding unit 100 and the open-and-shut unit 200 are detachably sealed.

The operation of delaying the separation of the skirt 340 of the second embodiment is equal to that of the first embodiment. However, according to the second embodiment, in the assembly of the bottle cap, the additive holding unit 100 is press-fitted into the mouth 11 of the bottle 10, and both the outer cap unit 300 and the floor member 120' are capped, as shown in FIG. 10. Thereby, the bottle cap is assembled, as shown in FIG. 11. In the state in which the sealing stopper 217 does not cover the bottle 10, the additive is put into the additive holding unit 100. Thereafter, the bottle is closed by the sealing stopper 217 so as to store contents. When the bottle cap according to the second embodiment is used, the operation of delaying the separation of the skirt 340 of the outer cap unit 300 remains the same as the first embodiment, so the description thereof will be omitted herein. However, according to the second embodiment, as shown in FIG. 12, while a sealing protrusion 125 provided around the floor member 120' is removed from a sealing groove 144 which is provided in the lower end of the open-and-shut unit 200, the opening 110 is opened, thus adding the additive to the contents of the bottle 10. Since the sealing operation of tube sealing tube 310 is equal to that of the first embodiment, it will not be described herein.

Figure 14:
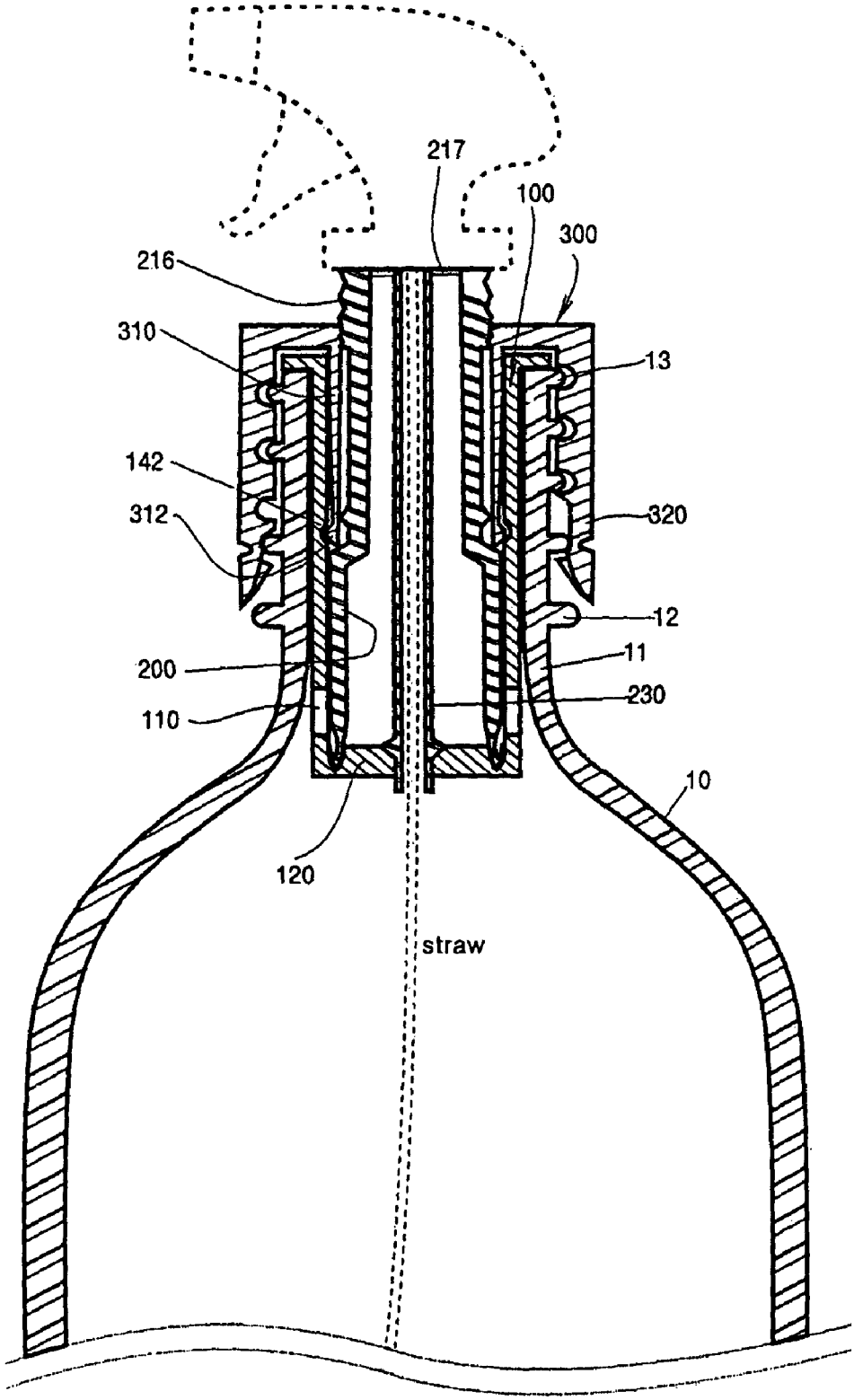
FIG. 14 is a sectional view illustrating a bottle cap with an additive supplying structure according to the third embodiment of the present invention.

FIG. 14 is a sectional view illustrating a bottle cap with an additive supplying structure according to the third embodiment of the present invention. The general construction of the bottle cap according to the third embodiment remains the same as the bottle cap according to the first embodiment. That is, the bottle cap includes an outer cap unit 300, an open-and-shut unit 200, and an additive holding unit 100.

A fastening thread 216, provided on the upper end of the open-and-shut unit 200, protrudes upwards from the upper end of the outer cap body 320, so that an additional coupling means is fastened to the fastening thread. The additional coupling means includes a straw guide tube 230 which is coaxially coupled to the open-and-shut unit 200, and the lower end of the straw guide tube 230 passes through the bottom of the additive holding unit 100. Since the operation of the third embodiment is similar to that of the first embodiment, the detailed description of the operation of the third embodiment will be omitted. Unlike the first embodiment, according to the third embodiment, a spray means is provided on the upper end of the open-and-shut unit 200, and the straw guide tube 230 is coaxially connected to the center of the open-and-shut unit 200. Thereby, contents are discharged through a straw which is inserted into the straw guide tube 230.

That is, first, the additive in the additive holding unit 100 is added to the contents in the bottle 10 by turning the outer cap unit 300, as in the first embodiment. Subsequently, when the bottle is used, the outer cap unit 300 is re-closed, so that the contents now containing the additive are discharged through the spray means.

As described above, the present invention provides a bottle cap with an additive supplying structure, which has a similar appearance to a conventional bottle cap, and in which, when the bottle cap is opened in the same manner as the conventional bottle cap, the separation of a skirt is delayed, and the additive is discharged and added to contents of a bottle while the separation of the skirt is being delayed, thus allowing the additive to be added to the contents without awkward additional manipulation, and which has a similar appearance to the conventional bottle cap, so that it is convenient to distribute and stock the bottle cap, and a manufacturing process is convenient, and a user can use the bottle cap unreluctantly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bottle cap with an additive supplying structure, comprising:

an additive holding unit supported in a mouth of a bottle by an upper flange, and having in a side surface of a lower portion thereof an opening for discharging the additive, the additive holding unit being open at a top thereof;

an open-and-shut unit seated to be coaxial with the additive holding unit, and moving up and down to open or shut the opening; and an outer cap unit, comprising:

a sealing tube placed between the open-and-shut unit and the additive holding unit, and performing a sealing function;

an outer cap body supporting at a center thereof the sealing tube, and fastened to an outer portion of the mouth of the bottle through a screw-type fastening method; and a coupling part provided on an inner wall of an upper end of the sealing tube to be coupled to the open-and-shut unit, wherein a skirt, having a forgery preventing function, is integrally provided on a lower end of the outer cap body and is secured to a skirt locking ring of the bottle, and a delay hook is provided on an inner wall of the skirt and retains the skirt for a period when the opening is opened by turning the outer cap unit, thus delaying separation of the skirt.

2. The bottle cap as set forth in claim 1, wherein an initial coupling hook is provided on an upper end of the inner wall of the skirt, and the delay hook is provided under the coupling hook in such a way that there is a predetermined height difference between the delay hook and the coupling hook provided on the upper end of the inner wall of the skirt.

3. The bottle cap as set forth in claim 1, wherein a wing-type contact part is provided on a lower end of the open-and-shut unit, and an annular wing seating groove is provided in an edge of a floor member of the additive holding unit in such a way as to be tapered in a direction from an upper end of the groove to a lower end thereof, so that the wing-type contact part is hermetically sealed by the annular wing seating groove.

4. The bottle cap as set forth in claim 1, wherein a sealing protrusion is provided on a lower end of the sealing tube, and is hermetically sealed by a sealing groove which is provided in an inner wall of a body which forms a sidewall of the additive holding unit.

5. The bottle cap as set forth in claim 1, wherein a cylindrical body, forming a sidewall of the open-and-shut unit, reduces at a middle inclined step thereof a diameter, thus providing a small-diameter part, and a fastening thread is provided on an outer portion of an upper end of the small-diameter part to be fastened to the coupling part, and a sealing stopper seals an inner portion of the upper end of the small-diameter part.

6. The bottle cap as set forth in claim 4, wherein a compression locking rib is provided on an outer wall of the body to be secured to an inner wall of the mouth of the bottle through press fitting.

7. The bottle cap as set forth in claim 1, wherein a bottom of the additive holding unit comprises a doughnut-shaped support, and a floor member is secured to an inner wall of the support using a locking hook, and the floor member of the additive holding unit and the open-and-shut unit are detachably sealed.

8. The bottle cap as set forth in claim 1, wherein a fastening thread provided on an upper end of the open-and-shut unit protrudes upwards from an upper end of the outer cap body, so that an additional coupling means is fastened to the fastening thread, and the additional coupling means comprises a straw guide tube which is coaxially coupled to the open-and-shut unit, and a lower end of the straw guide tube passes through the bottom of the additive holding unit.

9. The bottle cap as set forth in claim 2, wherein a wing-type contact part is provided on a lower end of the open-and-shut unit, and an annular wing seating groove is provided in an edge of a floor member of the additive holding unit in such a way as to be tapered in a direction from an upper end of the groove to a lower end thereof, so that the wing-type contact part is hermetically sealed by the annular wing seating groove.

10. The bottle cap as set forth in claim 2, wherein a sealing protrusion is provided on a lower end of the sealing tube, and is hermetically sealed by a sealing groove which is provided in an inner wall of a body which forms a sidewall of the additive holding unit.

11. The bottle cap as set forth in claim 10, wherein a compression locking rib is provided on an outer wall of the body to be secured to an inner wall of the mouth of the bottle through press fitting.

12. The bottle cap as set forth in claim 2, wherein a cylindrical body, forming a sidewall of the open-and-shut unit, reduces at a middle inclined step thereof a diameter, thus providing a small-diameter part, and a fastening thread is provided on an outer portion of an upper end of the small-diameter part to be fastened to the coupling part, and a sealing stopper seals an inner portion of the upper end of the small-diameter part.

13. The bottle cap as set forth in claim 2, wherein a bottom of the additive holding unit comprises a doughnut-shaped support, and a floor member is secured to an inner wall of the support using a locking hook, and the floor member of the additive holding unit and the open-and-shut unit are detachably sealed.

14. The bottle cap as set forth in claim 2, wherein a fastening thread provided on an upper end of the open-and-shut unit protrudes upwards from an upper end of the outer cap body, so that an additional coupling means is fastened to the fastening thread, and the additional coupling means comprises a straw guide tube which is coaxially coupled to the open-and-shut unit, and a lower end of the straw guide tube passes through the bottom of the additive holding unit.

* * * * *